US005947276A

United States Patent [19]

Hsu

[11] Patent Number: 5,947,276

[45] Date of Patent: Sep. 7, 1999

[54] PEN-CASE DEVICE

[76] Inventor: Jeou En Hsu, 5F, No. 14, Alley 8, Lane 45, Pao-Hsing Rd., Hsin-Tien City, Taipei Hsien, Taiwan

[21] Appl. No.: 08/965,413

[22] Filed: Nov. 6, 1997

[51] Int. Cl.[6] ..... A45C 11/34

[52] U.S. Cl. ..... 206/214; 206/215; 206/371; 211/69.1

[58] Field of Search ..... 206/214, 215, 206/224, 371; 211/69.1, 60.1, 89, 69.5, 65; 248/309.1, 314

[56] References Cited

U.S. PATENT DOCUMENTS

| | | | |
|---|---|---|---|
| 481,622 | 3/1889 | Craner | 206/443 |
| 2,121,307 | 6/1938 | Swift | 206/214 |
| 4,396,238 | 8/1983 | Torruella | 312/206 |
| 4,630,794 | 12/1986 | Rose | 248/309.1 |
| 5,601,194 | 2/1997 | Brinston | 211/13 |
| 5,738,228 | 4/1998 | Bittinger | 211/69.1 |

*Primary Examiner*—Paul T. Lam
*Assistant Examiner*—Nhan T. Sewell
*Attorney, Agent, or Firm*—Pro-Techtor International Services

[57] ABSTRACT

The present invention relates to an improvement pen-case device comprising a front clamp cover and a rear clamp cover, according to above architecture user not only could lay aside each kind of pens, but also lay up paper that could be more convenient to user for easy reading and operation. If add a magnet into present invention, it could absorb the scattered paper clip and pin; moreover, user also could put the clamp body at any absorbent place for flexible usage, meeting multi-purpose needs.

4 Claims, 5 Drawing Sheets

PEN-CASE DEVICE

BACKGROUND OF THE INVENTION

1. Field of the Invention

The present invention relates to an improvement pen-case architecture, thanks to this architecture allowing user not only could lay aside each kind of pens, but also lay up paper that could be more convenient to user for easy reading and operation; meantime, allowing user to absorb the scattered stationery like paper clip pin etc.

2. Description of the Prior Art

Due to the limited office space today, the available personal space further hard to get, so what requirements to stationery is ingenious and practical besides with well-designed appearance. Unfortunately, available current stationery always have beautiful looking but not so practical, hard to use and feels pity to throw away them. Take the most frequently used stationery like pen as the example, two to three set at most been frequently used, but most of situations what we could see is a pen case located on the desktop, occupying the narrow desktop space, much inconvenient is hard to avoid. Another example, the typing operator normally need one or two piece of paper for reference, the best way for increasing efficiency is to use typing machine. But it further reduce the limited office space; more troublesome problem is user sometimes has no idea to put into storehouse or just lay aside over there after using. Such conditions often make the user feels inconvenient even uncomfortable.

SUMMARY OF THE INVENTION

It is therefore a primary objective of the present invention to provide an ingenious and practical pen-case device, allowing user as normal pen holder usage, and could erect the paper information during typing. Such mechanism just like put the paper into the central section between thumb, the first finger and the middle finger, forcing the paper in vertical situation; further filly utilize the office space to increase the operation efficiency in office. If add a magnet into present invention, it could absorb the scattered paper clip and pin; moreover, user also could put the clamp body at any absorbent place for flexible usage, meeting multi-purpose needs.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

Figure 1:
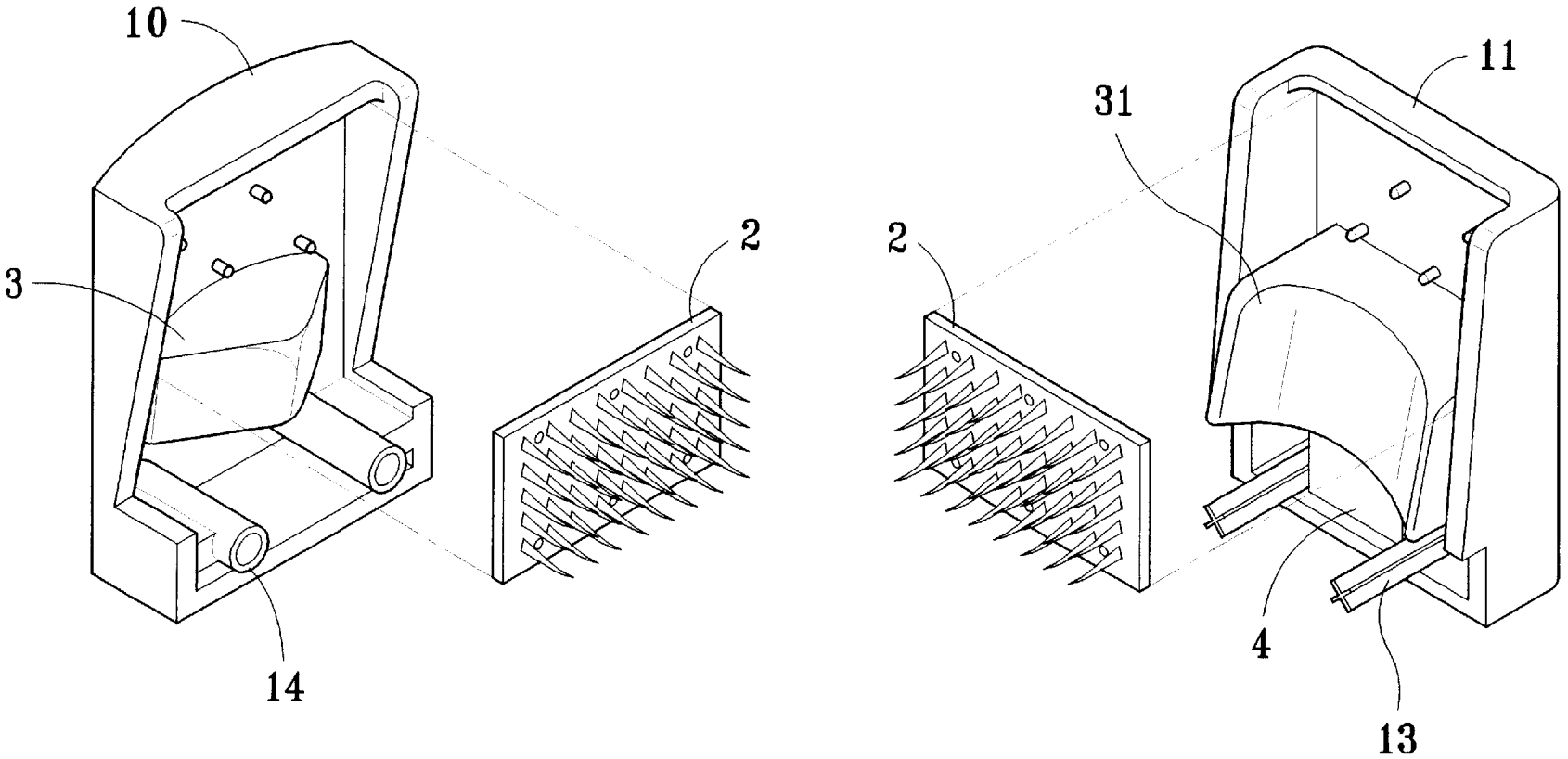
FIG. 1 is the exploded view of first implement example according to the present invention.
Figure 3:
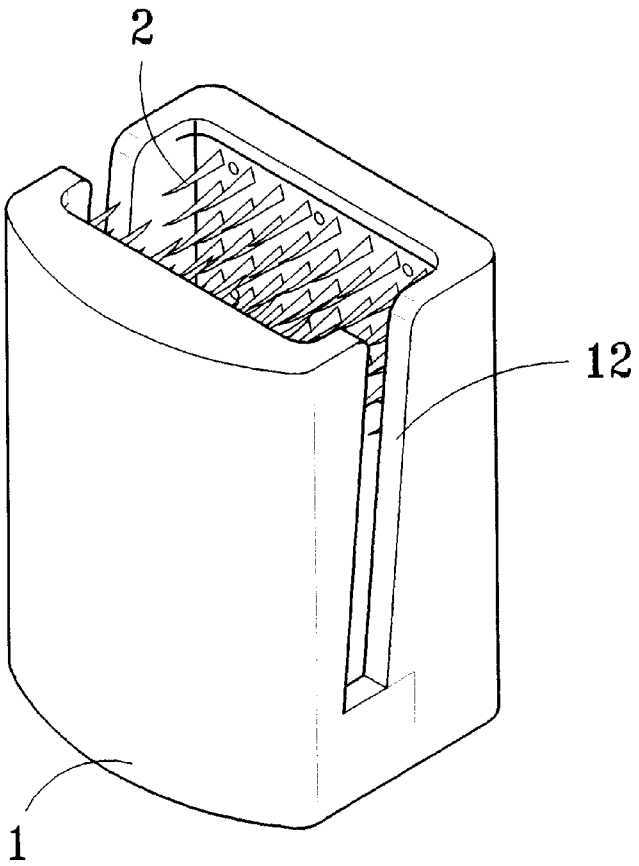
FIG. 3 is the general drawing of first implement example according to the present invention.

Please refer to FIG. 1 and FIG. 3. The present invention relates to an improvement pen-case device wherein comprising a clamp body 1 which is combined by a front clamp cover 10 and a rear clamp cover 11, and form an open groove 12 from top to bottom at both end. Furthermore, the clamp body 1 comprising a front clamp cover 10 in which installed internally with a convex splinter section 2, a paper clamping section and a linking section. A rear clamp cover 11 in which also installed internally with a convex splinter section 2, a paper clamping section and linking section. Furthermore, the convex splinter section 2 of said front clamp cover 10 and rear clamp cover 11 is made of flexible materials. Besides, the paper clamping section of front clamp cover 10 relates to a convex body 3 located at downside of the convex splinter section 2 which is installed at internal side of front clamp cover 10. And, the paper clamping section of rear clamp cover 11 relates to a concave bode 31 located at downside of the convex splinter section 2 which is installed at internal side of rear clamp cover 11. Moreover, the linking section located at internal side of front clamp cover 10 relates to two pin holes 14; and the linking section located at internal side of rear clamp cover 11 relates to two fix pin 13. After the combination based on above mechanism, the front clamp cover 10 and rear clamp cover 11 could link together become one set.

Figure 5:
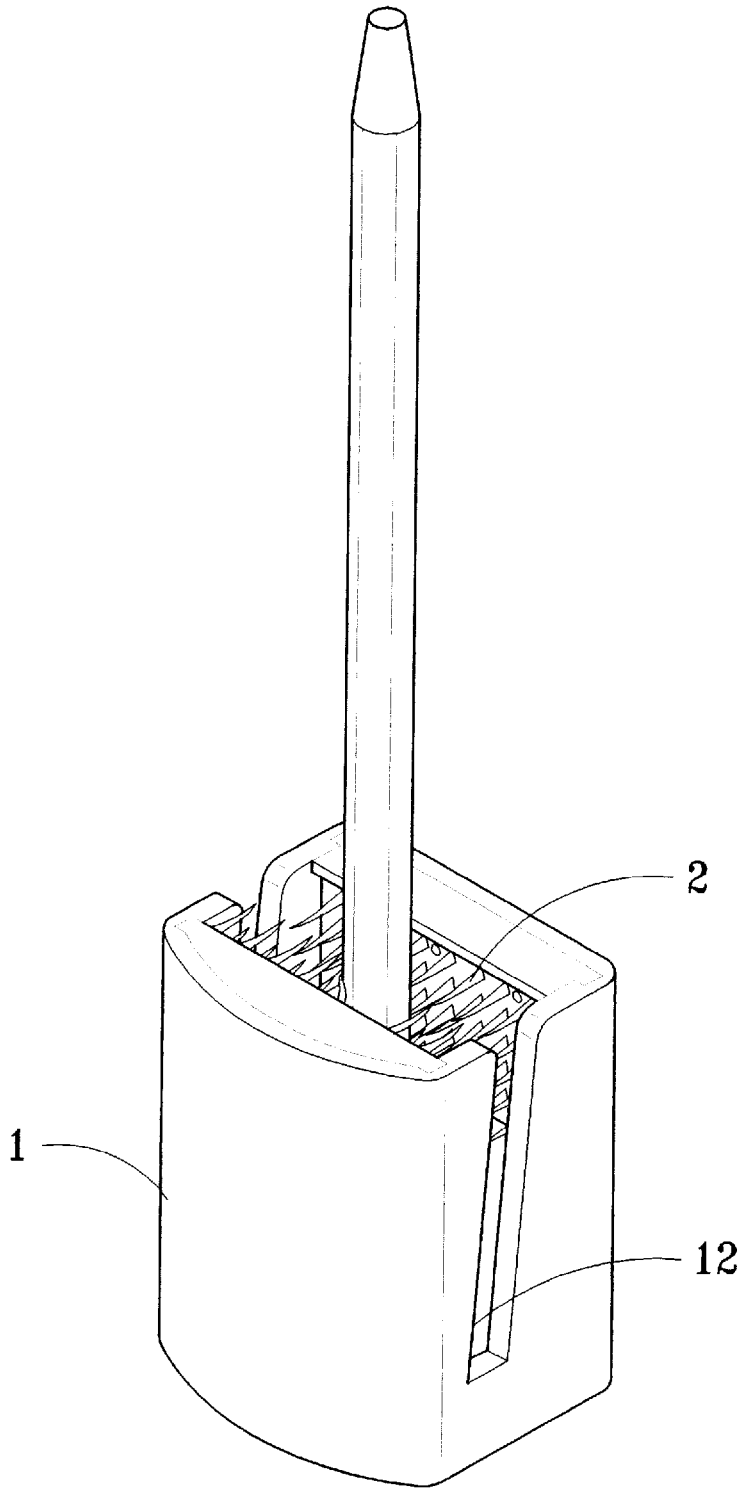
FIG. 5 is first application drawing according to the present invention.
Figure 6:
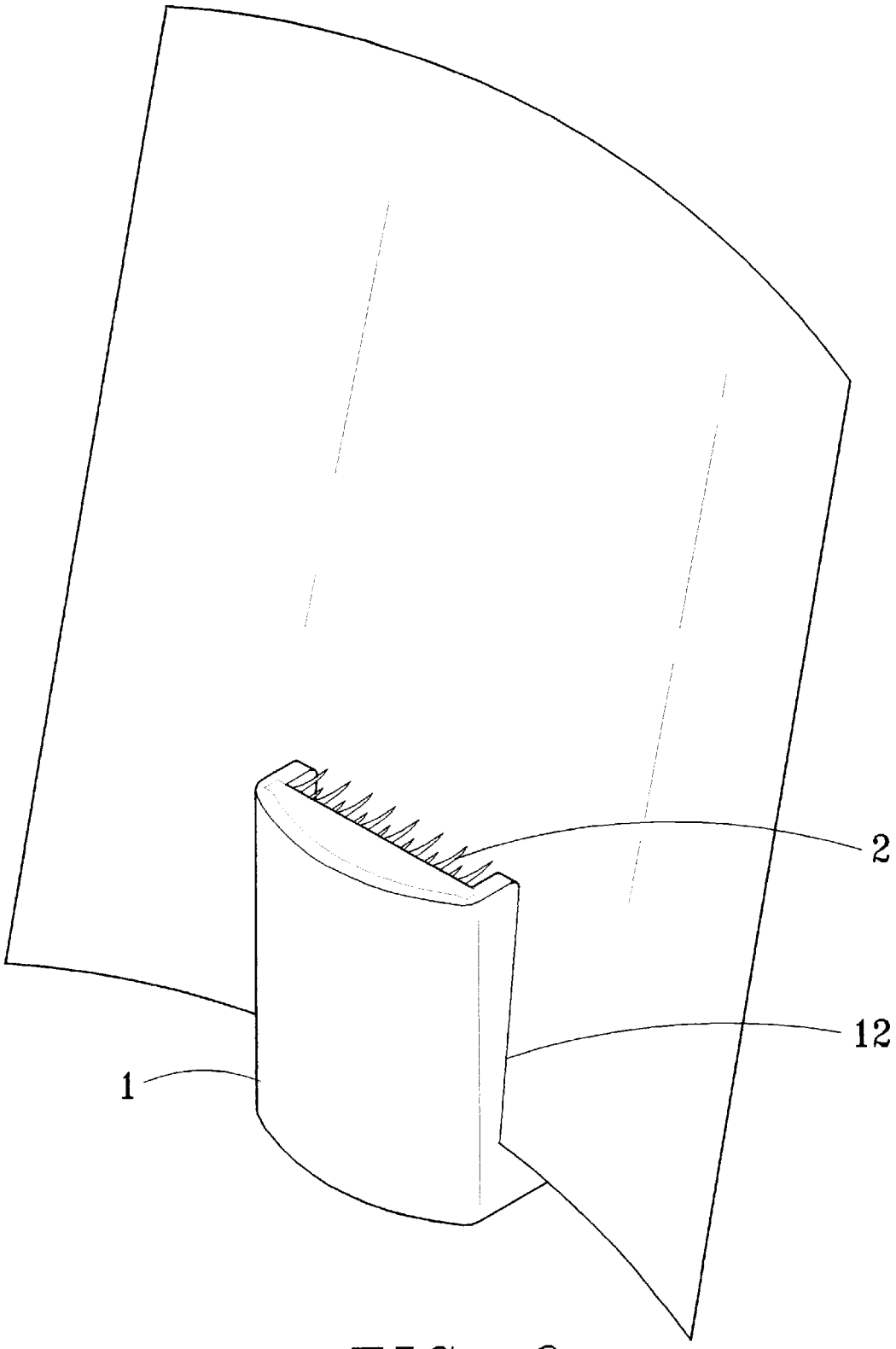
FIG. 6 is second application drawing according to the present invention.

According to the above architecture, user could put pen into the convex splinter section 2 vertically, and the pen will be not tilted due to the clamping action of flexible materials. (Please refer to FIG. 5) Moreover, the paper could pass through the slot between open groove 12 of clamp body 1 and paper clamping section from top to bottom, and be clamped in a stand-up way. (Please refer to FIG. 6) That means user could put paper pass through the arc-type slot formed by the convex body 3 of front clamp cover 10 and concave body 31 of rear clamp cover 11, the clamped paper will be forced into arc-shape and in a stand-up way.

Figure 2:
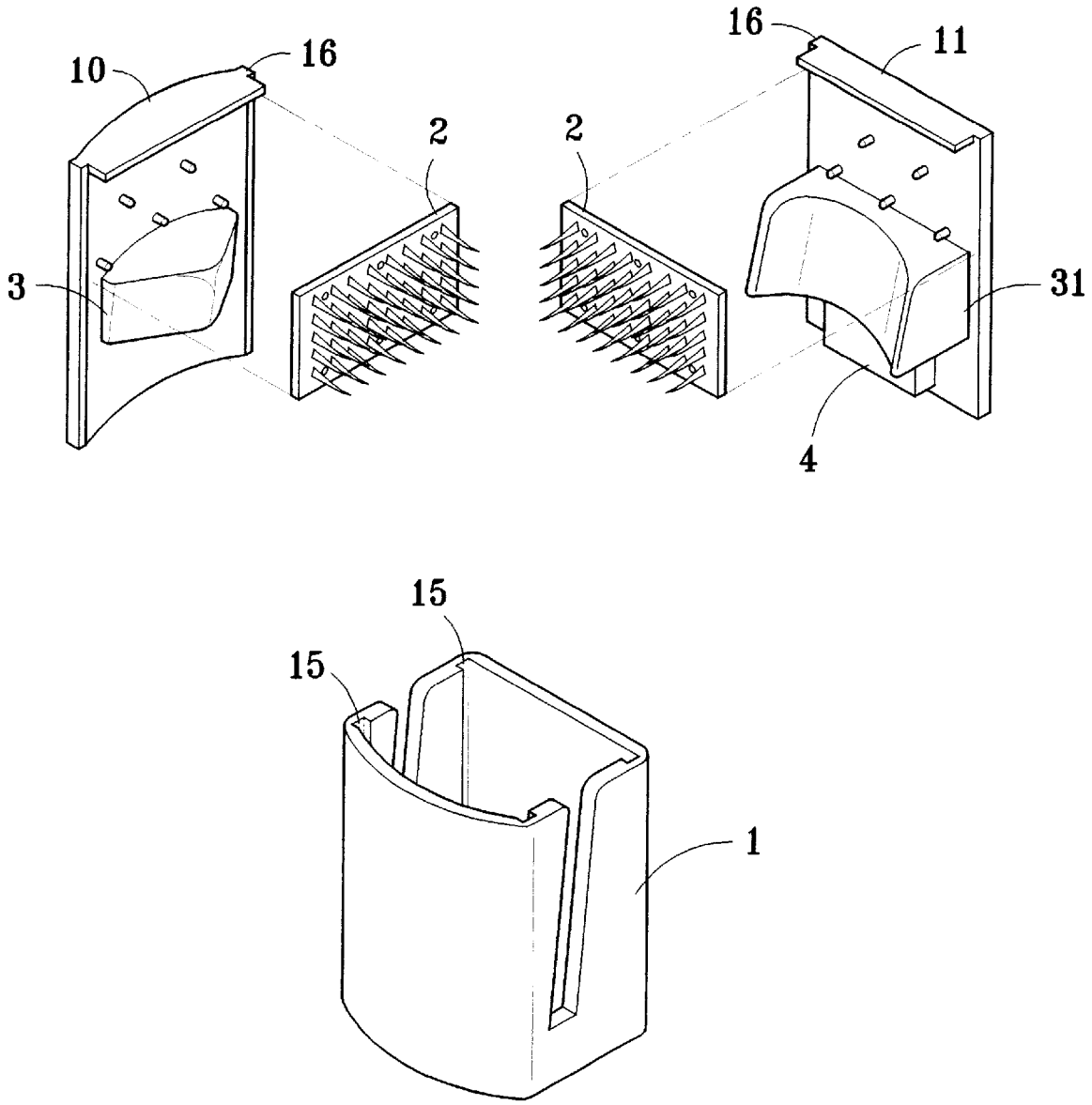
FIG. 2 is the exploded view of second implement example according to the present invention.
Figure 4:
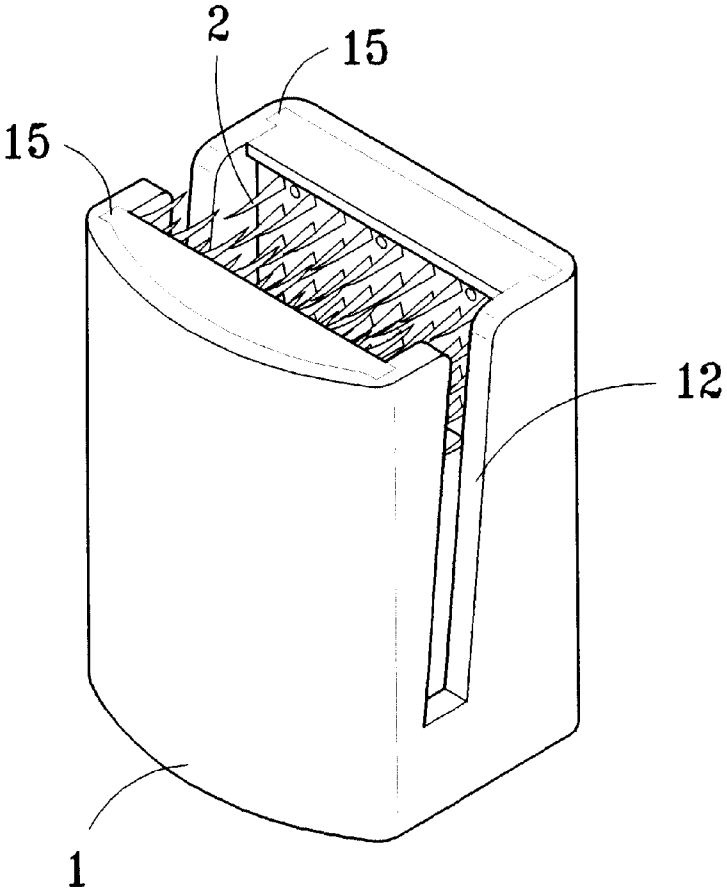
FIG. 4 is the general drawing of second implement example according to the present invention.

Please refer to FIG. 2 and FIG. 4 that relates to the second implement example according to the present invention comprising a tub-shape clamp body 1 in which set up an open groove 12 at both end from top to bottom been used to clamp the paper. Furthermore, the internal side of front and rear end installed with a guide slot 15. A front clamp cover 10 wherein installed internally with a convex splinter section 2 which downside has a convex body 3. And both end of front clamp cover 10 also setup a flange 16 from top to bottom been used to insert front clamp cover 10 into guide slot 15 of clamp body 1. Besides, a rear clamp cover 11 wherein installed internally with a convex splinter section 2 which downside has a concave body 31. And both end of rear clamp cover 11 also setup a flange 16 from top to bottom been used to insert rear clamp cover 11 into guide slot 15 of clamp body 1. The convex splinter section 2 pertains to front clamp cover 10 and rear clamp cover 11 described above is made of flexible materials. Therefore, according to such kind of architecture allow user could insert pen into convex splinter section 2 vertically and pen will be not tilted. Moreover, user also could simultaneously put paper into open groove 12 of clamp body 1, and arc-shape slot formed by convex body 3 of front clamp cover 10 and concave body 31 of rear clamp cover 11. The paper will be clamped and forced into arc-shape and in a stand-up way.

For the real application, both the above two implement examples could set up a magnet 4 under the clamp body 1 to absorb the scattered stationery like paper clip, pin etc. (Please refer to FIG. 1 and FIG. 2) Moreover, user also could put the clamp body 1 at any absorbent place for flexible usage, or add the glue materials at the surface side of clamp body 1, user could attach at any convenient place like at personal computer side, it shows present invention could provide multiple and practical operation.

Many changes and modifications in the above described embodiment of the invention can, of course, be carried out without departing from the scope thereof Accordingly, to promote the progress in science and the useful arts, the invention is disclosed and is intended to be limited only by the scope of the appended claims.

What is claimed is:

1. A pen-case device comprising:

a clamp body comprising a first clamp cover and a second clamp cover, said clamp body includes in two sides thereof an elongated slot, each said slot is open on a top side thereof; wherein said first clamp cover comprises a first convex splinter section, a first paper clamping section, and a linking section, said first convex splinter section comprises a plurality of flexible projections extending from an inner surface of a side wall of said first clamp cover into a central area of said clamp body, said second clamp cover comprises a second convex splinter section, a second paper clamping section, and a linking section, said second convex splinter section comprises a plurality of flexible projections extending from an inner surface of a side wall of said second clamp cover into a central area of said clamp body; such that when said linking section of said first clamp cover is joined with said linking section of said second clamp cover, a narrow arcuate slot between said first paper clamping section and said second paper clamping section is formed, so that articles inserted into said open groove are secured in said clamp body and are held in an upright orientation.

2. The pen-case device of claim 1 wherein:

said first paper clamping section comprises a convex body located beneath said first convex splinter section, and said second paper clamping section comprises a concave body located beneath said second convex splinter section.

3. The pen-case device of claim 1 wherein:

one of said link sections comprises a plurality of projection receiving holes, and a second of said link sections comprises a like number of projections, so that said projections are received in said projection receiving holes when said linking section of said first clamp cover is joined with said linking section of said second clamp cover.

4. The pen-case device of claim 1 wherein:

said clamp body further comprises a magnet.

* * * * *